US010953428B2

(12) United States Patent
Pozanc et al.

(10) Patent No.: US 10,953,428 B2
(45) Date of Patent: Mar. 23, 2021

(54) FLUID APPLICATOR DEVICE WITH FLUID CONTROL MECHANISM

(71) Applicant: Wagner Spray Tech Corporation, Plymouth, MN (US)

(72) Inventors: Doug Paul Pozanc, Winona, MN (US); Ross Rossner, St. Michael, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/860,321

(22) Filed: Jan. 2, 2018

(65) Prior Publication Data

US 2018/0193874 A1 Jul. 12, 2018

Related U.S. Application Data

(60) Provisional application No. 62/443,231, filed on Jan. 6, 2017.

(51) Int. Cl.

| | |
|---|---|
| ***B05C 17/00*** | (2006.01) |
| ***B05C 17/005*** | (2006.01) |
| ***B65D 47/42*** | (2006.01) |
| ***B05C 11/10*** | (2006.01) |

(Continued)

(52) U.S. Cl.

CPC ..... *B05C 11/1026* (2013.01); *B05C 1/06* (2013.01); *B05C 5/0258* (2013.01); *B05C 17/00* (2013.01); *B05C 17/002* (2013.01); *B05C 17/00513* (2013.01); *B05C 17/00516* (2013.01); *B05C 17/003* (2013.01); *B65D 47/42* (2013.01)

(58) Field of Classification Search

CPC ..... A47L 13/22; A47L 13/26; A47L 13/312; A47L 13/316; F16K 35/025; B65D 47/242; B65D 47/246

USPC ..... 401/205, 138, 263, 275, 281; 251/112, 251/227

See application file for complete search history.

(56) References Cited

U.S. PATENT DOCUMENTS 851,338 A * 4/1907 Barnhouse ..... F16K 35/025 251/104
1,357,024 A * 10/1920 Behrman ..... B65D 47/242 222/521
2,187,671 A 1/1940 Suddarth (Continued)

FOREIGN PATENT DOCUMENTS

EP 0461873 A3 12/1991
EP EP-1075817 A2 * 2/2001 ..... A47L 13/22

(Continued)

OTHER PUBLICATIONS

Wagner DeckMate User Manual, 4 pages, available at least at Jan. 5, 2017.

(Continued)

*Primary Examiner* — David P Angwin
*Assistant Examiner* — Bradley S Oliver
(74) *Attorney, Agent, or Firm* — Christopher J. Volkmann; Kelly, Holt & Christenson, PLLC

(57) ABSTRACT

An example fluid applicator device includes an applicator assembly, and a reservoir assembly configured to store a fluid and is rotatable, relative to the applicator assembly, to control a valve mechanism that controls a flow of the fluid from the reservoir assembly to the applicator assembly, wherein the applicator assembly is configured to apply the fluid to a surface.

20 Claims, 11 Drawing Sheets

(51) Int. Cl.
*B05C 1/06* (2006.01)
*B05C 5/02* (2006.01)

(56) References Cited

U.S. PATENT DOCUMENTS 2,460,270 A * 2/1949 Ashley ..... F16K 21/14 251/66
2,575,124 A * 11/1951 Pollitt ..... A47L 13/30 222/162
2,601,689 A * 7/1952 Mallard ..... A47L 13/312 401/205
2,702,396 A * 2/1955 Straszer ..... A46B 11/0013 401/281
3,261,515 A * 7/1966 Luedtke ..... B65D 47/42 222/520
3,286,978 A * 11/1966 Lansky ..... F16L 15/008 251/112
3,690,779 A 9/1972 Ellis
4,119,386 A 10/1978 Cushing
4,152,084 A 5/1979 Melton et al.
4,250,586 A 3/1981 Timian
4,611,941 A 9/1986 Karliner et al.
4,732,503 A 3/1988 Bader et al.
4,822,194 A 4/1989 Simonette
4,846,799 A 7/1989 Tanaka et al.
5,454,656 A 10/1995 Rowe
5,505,346 A * 4/1996 Smith ..... B05B 11/3001 222/505
6,692,172 B1 * 2/2004 Hsu ..... A47L 13/22 15/104.93
6,953,299 B2 10/2005 Wang et al.
7,192,210 B2 * 3/2007 Svendsen ..... A46B 11/0013 15/114
7,306,389 B2 12/2007 Wakat
7,325,990 B2 2/2008 Svendsen et al.
7,841,796 B2 11/2010 Bruggeman et al.
7,891,900 B2 2/2011 Clarke
8,029,207 B2 * 10/2011 Schouten ..... A47L 13/22 401/280
8,210,760 B2 7/2012 Sandahl et al.
8,276,538 B2 10/2012 Ling et al.
8,479,348 B2 7/2013 DeCarr
8,596,896 B2 12/2013 Kimura
8,939,670 B2 * 1/2015 Choi ..... A46B 11/002 401/281
9,266,139 B2 2/2016 Bruggeman et al.
2006/0228160 A1 10/2006 Lim et al.
2009/0100624 A1 4/2009 MacCormick
2011/0013968 A1 1/2011 Donegan et al.
2014/0227450 A1 8/2014 Hironimus

FOREIGN PATENT DOCUMENTS

WO 2009/088539 A1 7/2009
WO 2009/121857 A1 10/2009
WO 2010/127931 A2 10/2010

OTHER PUBLICATIONS

Cuprinol Power Pad for Decking User Guide, 12 pages, Mar. 2009.
Cuprinol PowerPad for Decking, http://cuprinol.co.uk/products/powerpad_for_decking_overview, 2009.
Woodmates Stain Applicator Brochure, 8 pages, Mr. LongArm. Inc., 2011.
Shurline Deck Solutions, http://shurline.com/products/deck-solutions.aspx, 2011.

* cited by examiner

FLUID APPLICATOR DEVICE WITH FLUID CONTROL MECHANISM

CROSS-REFERENCE TO RELATED APPLICATION

The present application is based on and claims the benefit of U.S. provisional patent application Ser. No. 62/443,231, filed on Jan. 6, 2017, the contents of which are hereby incorporated by reference in its entirety.

BACKGROUND

The present disclosure generally relates to tools that apply a fluid to a surface. There are a wide variety of such tools that include brushes, rollers, pumps, sprayers, and surface pads, among others. Examples of fluids include paint, varnish, stain, thinners, solvents, and the like.

The discussion above is merely provided for general background information and is not intended to be used as an aid in determining the scope of the claimed subject matter.

SUMMARY

In one example, a fluid applicator device includes an applicator assembly, and a reservoir assembly configured to store a fluid and is rotatable, relative to the applicator assembly, to control a valve mechanism that controls a flow of the fluid from the reservoir assembly to the applicator assembly, wherein the applicator assembly is configured to apply the fluid to a surface These and various other features and advantages will be apparent from a reading of the following Detailed Description. This Summary and Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

DETAILED DESCRIPTION

The present disclosure generally provides a fluid applicator device with a user-operated valve mechanism that controls fluid flow. Fluid flow generally refers to the rate at which fluid is moved from one location to another, such as from one location within the device to another location outside or near an exit of the assembly. The valve mechanism generally controls the flow of fluid from a reservoir that holds the fluid to an applicator assembly that dispenses the fluid to a surface. The applicator assembly can include, for example, a pad or other type of applicator that contacts a work surface, such as but not limited to a floor, wall, or other planar surface, to apply the fluid to the work surface. As will be discussed in further detail below, some components of the fluid applicator assembly are rotatable, while other components are configured to remain in a substantially fixed orientation, relative to the work surface, to open or close a valve for controlling a flow of fluid to the applicator assembly. In operation, the features described herein can allow a user to easily control the fluid flow rate to the work surface.

Figure 1:
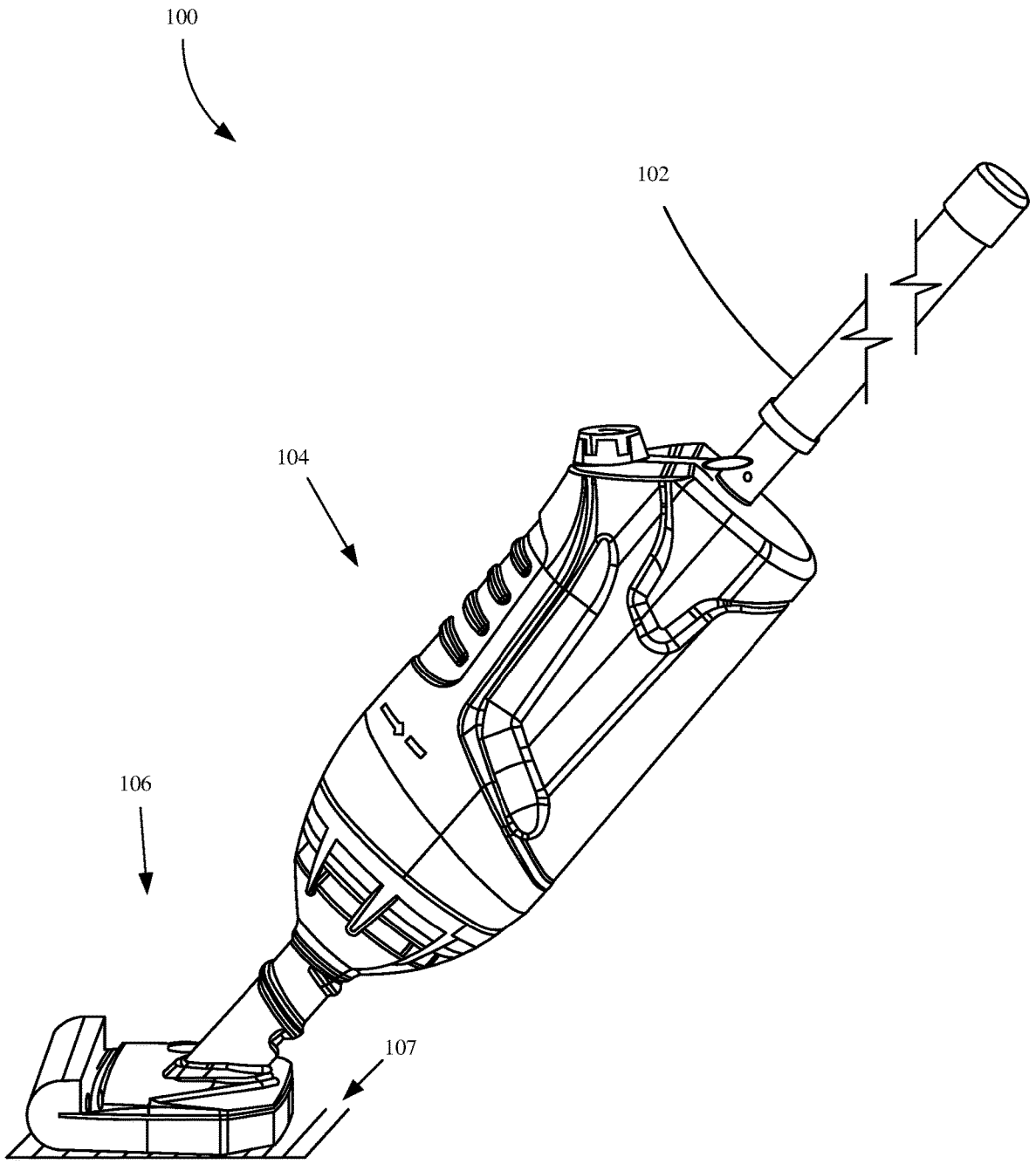
FIG. 1 illustrates a perspective view of a fluid applicator device, in accordance with one embodiment.

FIG. 1 illustrates a perspective view of a fluid applicator device 100, in accordance with one embodiment. Fluid applicator device 100 illustratively includes a handle 102, a reservoir assembly 104, and an applicator assembly 106. Prior to discussing the features of fluid applicator device 100 in detail, a brief overview of fluid applicator device 100 will be described with respect to FIG. 1.

Reservoir assembly 104 is generally configured to hold a fluid that is released to, and accumulated by, applicator assembly 106 which dispenses the fluid to a work surface 107 (e.g., hereinafter—"surface"). In one example of operation, a user can grip handle 102, and/or reservoir assembly 104 to move applicator assembly 106 across work surface 107 such that applicator assembly 106 applies the fluid to work surface 107.

Fluid applicator device 100 is also configured to control a rate at which the fluid is accumulated by applicator assembly 106. To control fluid flow, fluid applicator device 100 includes one or more rotatable components. The rotatable components are configured to rotate to control a valve mechanism. The valve mechanism permits the flow of fluid from reservoir 108 to applicator assembly 106 when the valve mechanism is open, and prevents the flow of fluid to applicator assembly 106 when the valve mechanism is closed. The components are rotatable, for example by a helical coupling, to controllably increase or decrease the rate of fluid flow to applicator assembly 106. In operation, a user can rotate portions of fluid applicator device 100, such as handle 102 and/or reservoir assembly 104, to thereby control a rate at which the fluid is applied to work surface 107.

Figure 2:
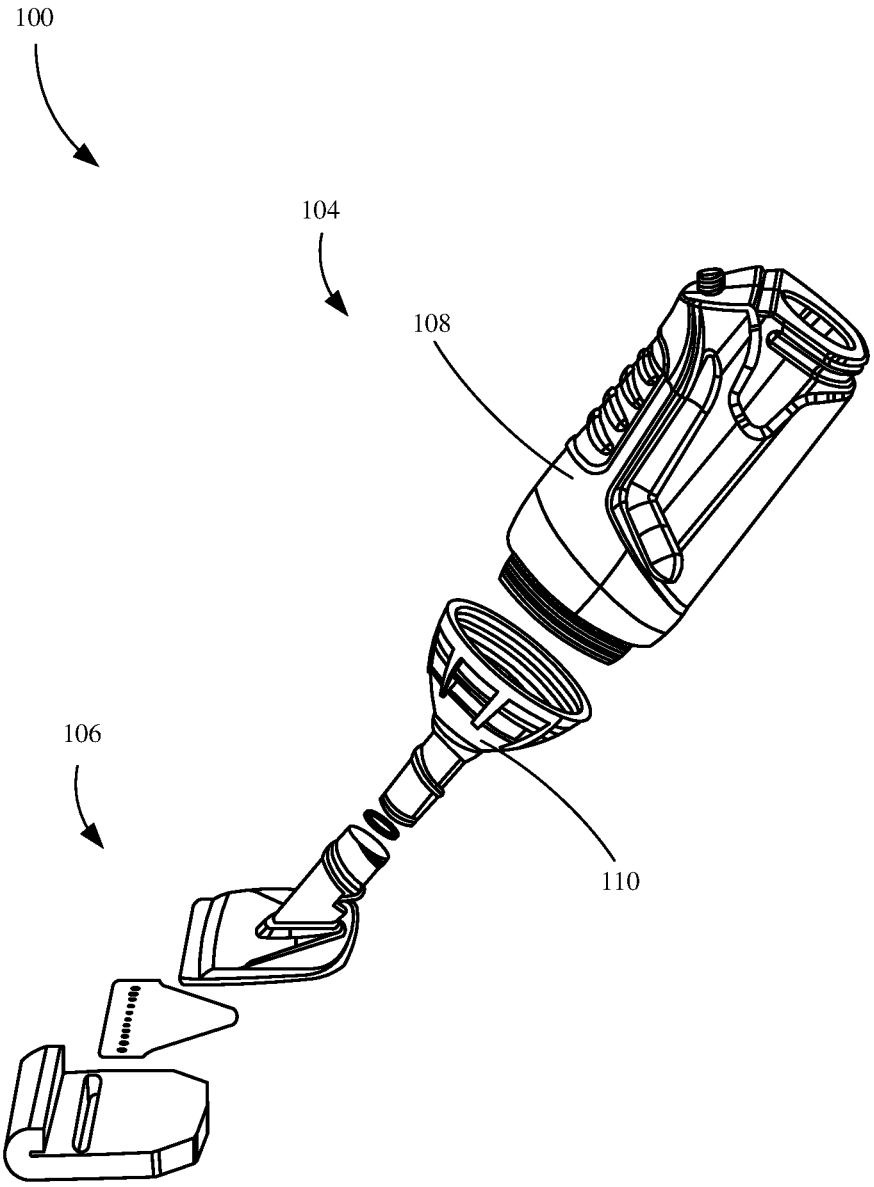
FIG. 2 illustrates an exploded view of the fluid applicator device shown in FIG. 1.

FIG. 2 illustrates an exploded view of fluid applicator device 100 shown in FIG. 1. Reservoir assembly 104 includes a reservoir housing 108, forming a reservoir therein (hereinafter—"reservoir" 108) and a flow regulator 110. Flow regulator 110 is shown in FIG. 2 detached from reservoir 108. In this example, reservoir 108 is coupled to flow regulator 110 and rotatable to impart a corresponding rotation to flow regulator 110 in a same direction of rotation. As discussed in further detail below, rotation of flow regulator 110 controls a valve mechanism.

Figure 3:
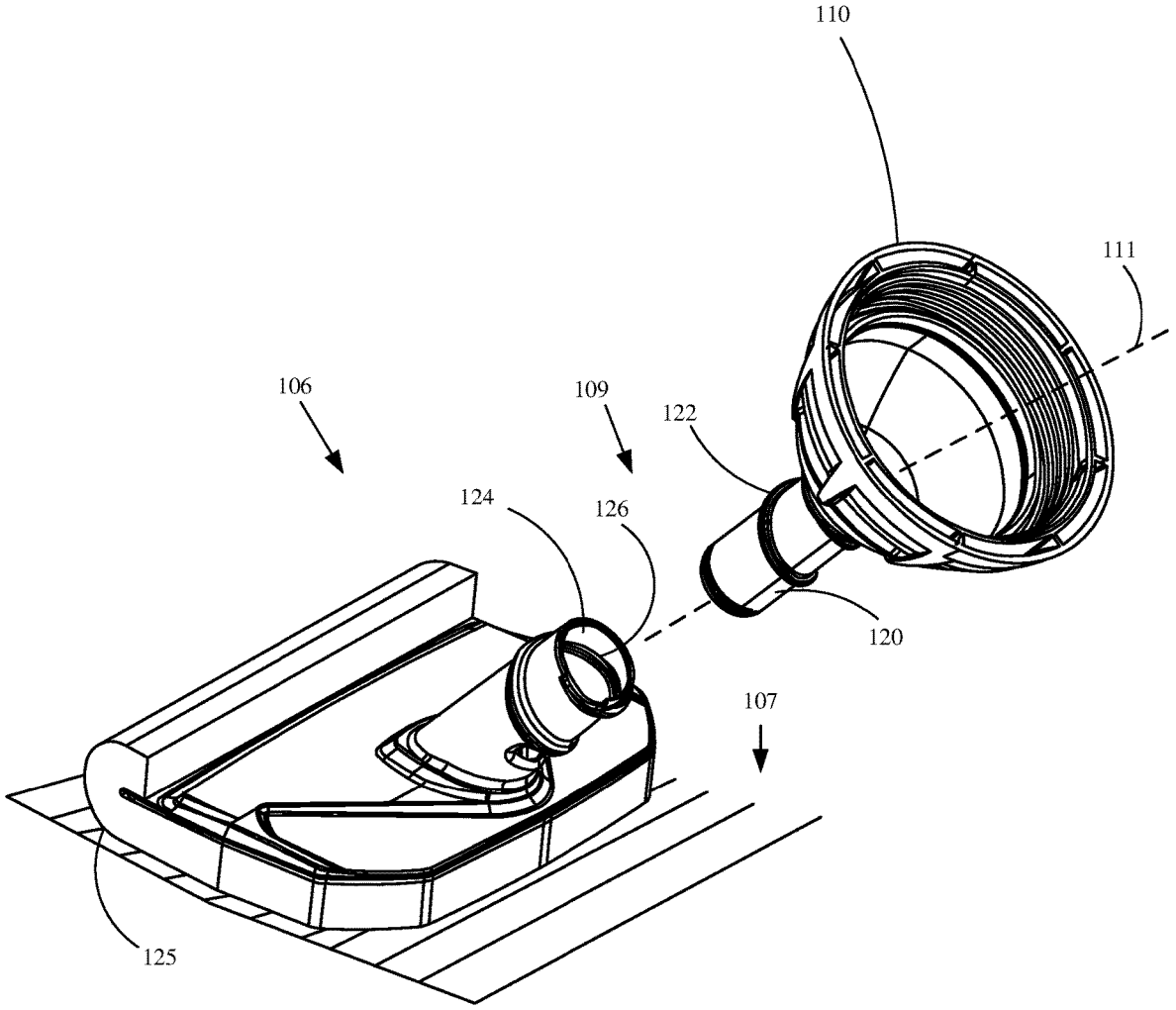
FIG. 3 illustrates a partial-exploded view of a flow regulator and an applicator assembly of a fluid applicator device, in accordance with one embodiment.

FIG. 3 illustrates a partial-exploded view of flow regulator 110 and applicator assembly 106 of fluid applicator device 100, in accordance with one embodiment. Flow regulator 110 and applicator assembly 106 form a helical coupling 109 that is configured to control a valve mechanism. In the illustrated example, flow regulator 110 is configured to open and close the valve mechanism based on rotation of flow regulator 110, about an axis 111, relative to applicator assembly 106. A bottom surface 125 of applicator assembly 106 contacts work surface 107 and, due to friction between work surface 107 and bottom surface 125, applicator assembly 106 remains in a substantial static rotational orientation relative to axis 111.

Flow regulator 110 illustratively includes a stem 120 that is configured to engage a portion of applicator assembly 106. Stem 120 is a cylindrical structure that is disposed at an end of flow regulator 110 opposite an end at which flow regulator 110 is couplable to reservoir 108 (e.g., see FIG. 9). Stem 120 illustratively includes a thread 122 that is disposed around an exterior surface of stem 120. Thread 122 generally defines a surface that extends helically around stem 120.

Applicator assembly 106 illustratively includes an applicator stem 124. Applicator stem 124 comprises a cylindrical structure that is disposed at an end of applicator assembly 106 opposite bottom surface 125. Applicator stem 124 illustratively includes an applicator thread 126 disposed along an interior surface of applicator stem 124. Applicator thread 126 generally defines a surface that extends helically around an interior of applicator stem 124.

In the illustrated example, thread 122 and applicator thread 126 are disposed on stems 120 and 124, respectively, to form helical coupling 109 that allows flow regulator 110 to movably engage applicator assembly 106. That is, stem 120 is configured to engage (e.g., insert into) applicator stem 124 such that thread 122 engages applicator thread 126. In operation, when flow regulator 110 is rotated, stem 120 moves along the engagement between threads 122 and 126. Movement of stem 120 along threads 122 and 126 correspondingly moves flow regulator 110 in a direction towards or away from applicator assembly 106 to thereby control a valve mechanism that controls fluid flow, as will be discussed in further detail below with respect to FIG. 5. Of course, flow regulator 110 can be configured to move in another way that is relative to a correspondingly fixed orientation of applicator stem 124 (and thus to a correspondingly fixed orientation of applicator assembly 106). Therefore, FIG. 4 illustratively shows that fluid applicator device 100 includes a helical arrangement (e.g., helical coupling 109) that defines a valve mechanism, and movement of portion of fluid applicator device 100, along the helical arrangement, controls the valve mechanism to thereby control fluid flow.

Figure 4:
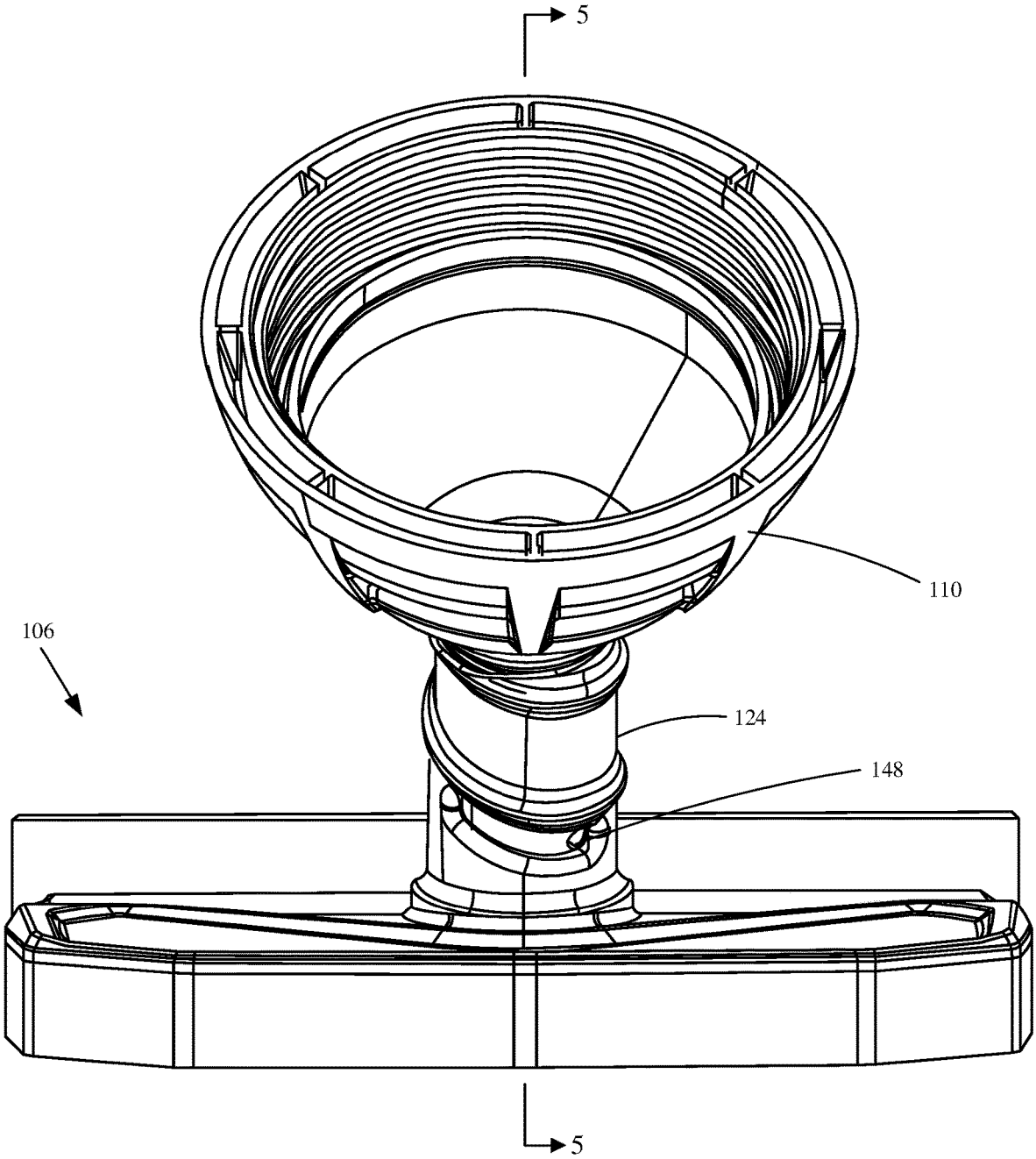
FIG. 4 illustrates a perspective view of the flow regulator and applicator assembly of the fluid applicator device shown in FIG. 3.

FIG. 4 illustrates a perspective view of flow regulator 110 and applicator assembly 106 of fluid applicator device 100 shown in FIG. 3. FIG. 4 illustratively shows stem 120 inserted into applicator stem 124. The movable arrangement of flow regulator 110, with respect to applicator assembly 106, will now be described in further detail below with respect to FIG. 5.

Figure 5:
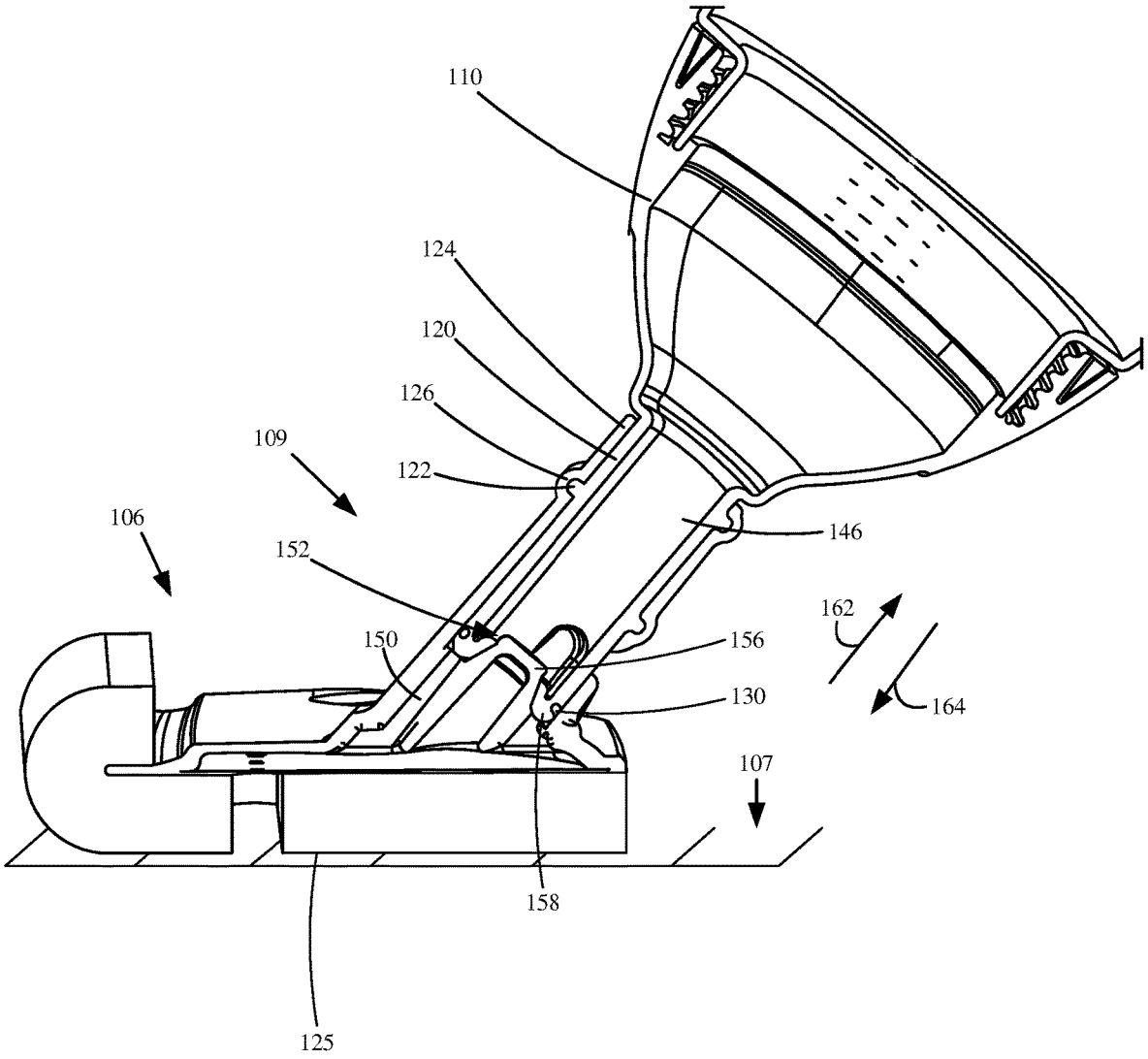
FIG. 5 illustrates a cross-sectional view of the flow regulator and the applicator assembly of the fluid applicator device, shown in FIG. 4, taken at line 5-5.

FIG. 5 illustrates a cross-sectional view of flow regulator 110 and applicator assembly 106 of fluid applicator device 100, shown in FIG. 4, taken at line 5-5. FIG. 5 illustratively shows that fluid applicator device 100 includes a flow channel 146. Flow channel 146 generally defines a region disposed along an interior portion of stem 120, and thus also interior to applicator stem 124. Flow channel 146 is configured to form a conduit that carries fluid from flow regulator 110 to applicator assembly 106. That is, flow channel 146 is configured to receive fluid from flow regulator 110 and hold the fluid within flow channel 146 until the fluid is to be dispensed to applicator assembly 106.

Based on movement of stem 120 relative to applicator stem 124 (e.g., along helical coupling 109 via threads 122, 126, as discussed above with respect to FIG. 3), flow channel 146 is configured to open or close a valve mechanism 152 (e.g., at the location generally indicated by reference numeral 152). To move stem 120 relative to applicator stem 124, and thereby open or close valve mechanism 152, stem 120 is rotatable about axis 111. That is, stem 120 is configured to, based on rotation of flow regulator 110 about axis 111 in a first direction of rotation, move in a direction generally indicated by arrow 162, and thus in a direction that moves stem 120 away from applicator assembly 106. Stem 120 is also configured to, based on rotation of flow regulator 110 about axis 111 in a second direction of rotation (e.g., opposite a first direction of rotation), move in a direction generally indicated by arrow 164, and thus in a direction that moves stem 120 towards applicator assembly 106.

Applicator assembly 106 illustratively includes a protrusion 156 that is configured to engage a bottom portion 158 of stem 120. Movement of stem 120 correspondingly moves bottom portion 158 in a same direction, and thereby causes bottom portion 158 to either engage or disengage protrusion 156. When bottom portion 158 fully engages protrusion 156, valve mechanism 152 is closed and fluid is not permitted to flow to applicator assembly 106. When bottom portion 158 is at least partially disengaged from (e.g., does not contact) protrusion 156, valve mechanism 152 is opened and fluid is permitted to flow to applicator assembly 106.

Thus, flow regulator 110 is configured to be rotated about axis 111 in a first direction and correspondingly disengage stem 120 from protrusion 156, thereby opening valve mechanism 152 by forming a variable gap between stem 120 and protrusion 156. This gap permits fluid to flow through flow channel 146 to applicator assembly 106. Flow regulator 110 is configured to be rotated about axis 111 in a second direction and correspondingly cause stem 120 to at least partially engage (e.g., contact) protrusion 156, thereby closing valve mechanism 152 by decreasing the variable gap between stem 120 and protrusion 156. It is noted that a smaller sized or closed gap decreases or prevents, respectively, fluid to flow through flow channel 146 to applicator assembly 106.

In the illustrated example, flow channel 146 is a conduit channel that forms via helical coupling 109. The orientation of flow channel 146 with respect to valve mechanism 152 is variable, and is dependent on a degree of rotation of flow regulator 110 about axis 111. Therefore, fluid applicator device 100 is configured such that a user can rotate components (e.g., reservoir 108 and/or handle 102) to impart varying rotational distances to flow regulator 110, which thereby moves stem 120 towards or away from protrusion 156 to decrease or increase a size of a gap at valve mechanism 152. Thus, a user can vary rotation of fluid applicator device 100 to decrease or increase an amount of fluid that is provided to applicator assembly 106, through flow channel 146, and according to a valve position defined by valve mechanism 152.

It is noted that valve mechanism 152 is generally configured to be in the closed or sealed position during normal operation or when no rotation is imparted to flow regulator 110. For instance, flow regulator 110 is configured to maintain a resting state such that stem 120 is proximately near applicator assembly 106 and valve mechanism 152 is in the corresponding closed position. In one embodiment, fluid applicator device 100 is configured to return to the resting, or closed position of valve mechanism 152 automatically. For instance, in operation and when a user releases a portion of fluid applicator device 100 (e.g., where that portion was rotated to increase fluid flow), one or more portions of fluid applicator device 100 (e.g., flow regulator 110) will automatically rotate about axis 111 and move down along helical coupling 109, so to speak, to return to a position that closes valve mechanism 152.

In addition, in the illustrated example, a sealing engagement that includes an O-ring 130 is disposed around an exterior of stem 120 such that a leak-proof seal is formed between an interior side wall of applicator stem 124 and an exterior side wall of stem 120. O-ring 130 can therefore form a sealing engagement that prevents fluid from undesirably leaking from within flow channel 146. In one example, O-ring 130 forms a sealing engagement when valve mechanism 152 is in the closed position.

Fluid applicator device 100 also illustratively includes a locking mechanism 148 (e.g., FIGS. 4 and 5) that secures a position of flow regulator 110 with respect to applicator assembly 106. That is, locking mechanism 148 is generally configured to prevent rotation of flow regulator 110. By securing the position of flow regulator 110 with respect to applicator assembly 106, locking mechanism 148 generally provides a mechanism for maintaining a rate of fluid flow with respect to a current orientation of valve mechanism 152 that corresponds to a current position of flow regulator 110. In the illustrated example, locking mechanism 148 includes a slot configured to receive a thumb screw that secures a portion of stem 120 with respect to applicator stem 124. Insertion of the thumb screw into the slot, which is disposed along and accessible via an exterior of stems 120 and 124, can allow a user to prevent undesired rotation of flow regulator 110, and thereby maintain a relatively constant flow of fluid through flow channel 146 and to applicator assembly 106. Removing the thumb screw from locking mechanism 148 generally permits applicator assembly 106 to disengage (e.g., be rotated off) flow regulator 110 for cleaning or easy transportation of fluid applicator device 100. Of course, a variety of other screws or locking mechanisms can also or alternatively be used.

Figure 6:
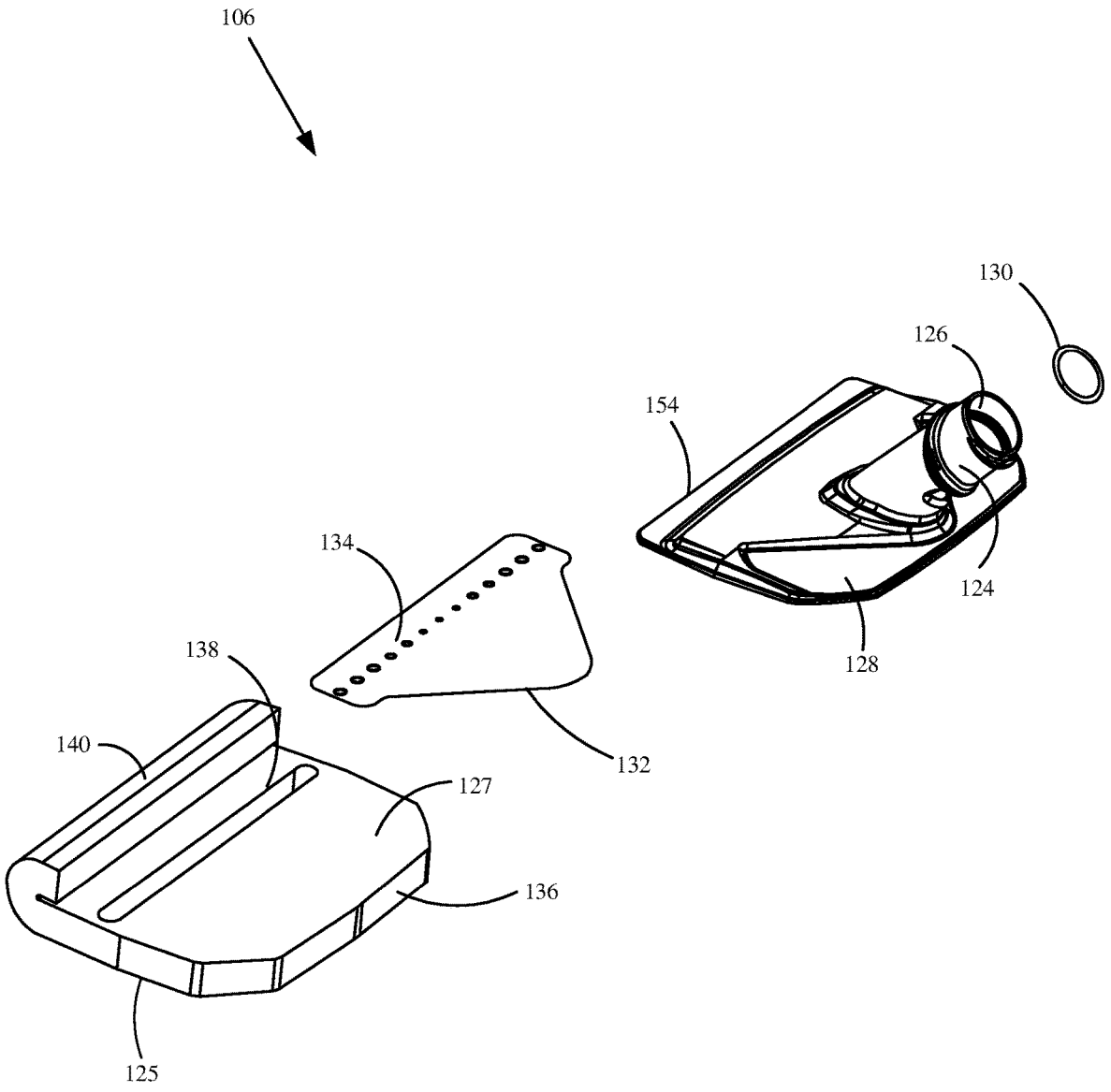
FIG. 6 illustrates an exploded view of an applicator of a fluid applicator device, in accordance with one embodiment.
Figure 7:
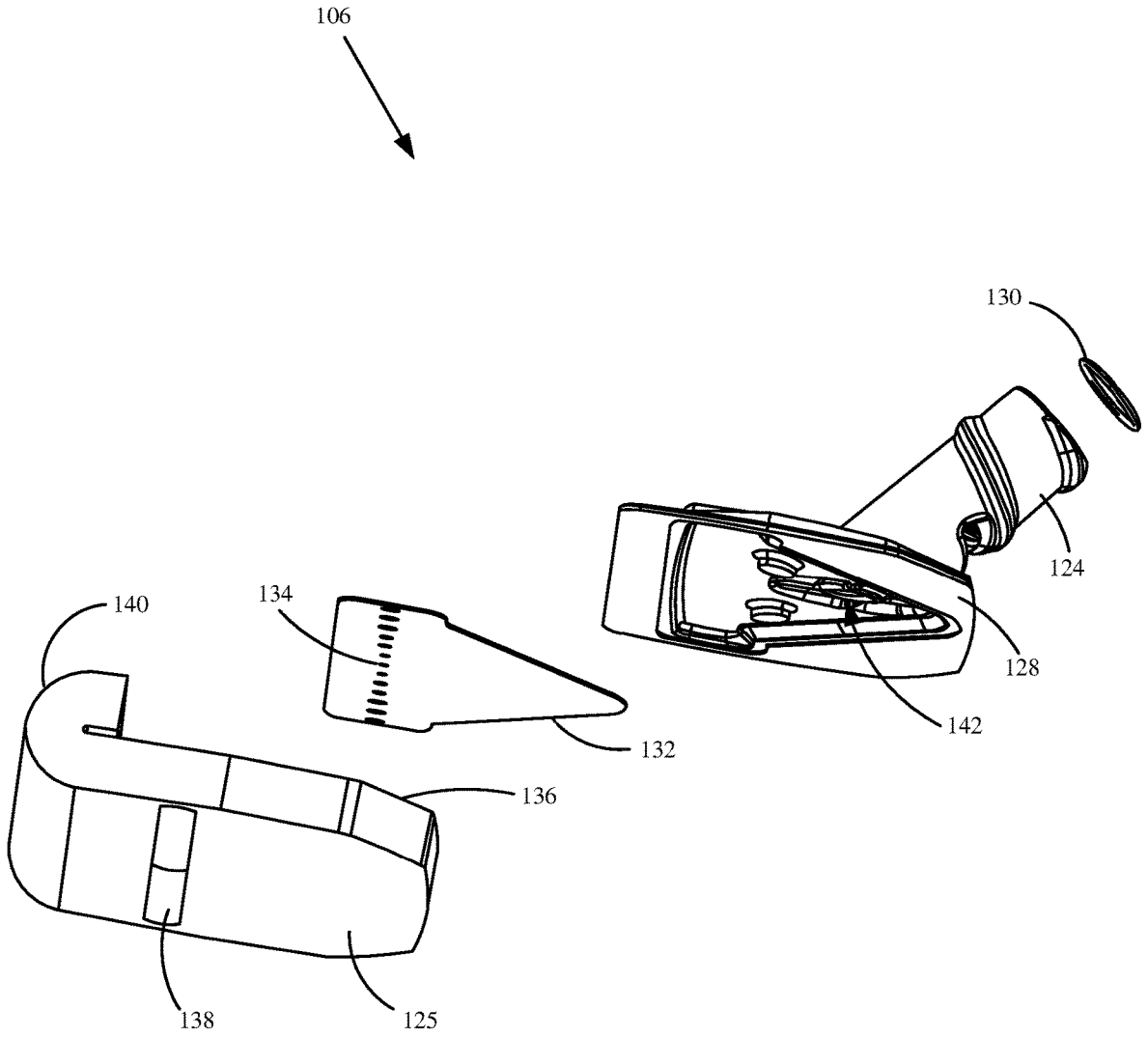
FIG. 7 illustrates a perspective view of the exploded view of the applicator assembly shown in FIG. 6.

FIG. 6 illustrates an exploded view of applicator assembly 106 of fluid applicator device 100, in accordance with one embodiment. FIG. 7 illustrates a perspective view of the exploded view of applicator assembly 106 shown in FIG. 6. Features of applicator assembly 106 will now be discussed in further detail with respect to FIGS. 6 and 7.

Applicator assembly 106 illustratively includes an applicator base 128. In the illustrated example, applicator base 128 is coupled to applicator stem 124 at a first end, and is configured to fluidically couple with flow channel 146 near the first end. The fluidic coupling between flow channel 146 and applicator base 128 will be briefly described with respect to FIG. 8.

Figure 8:
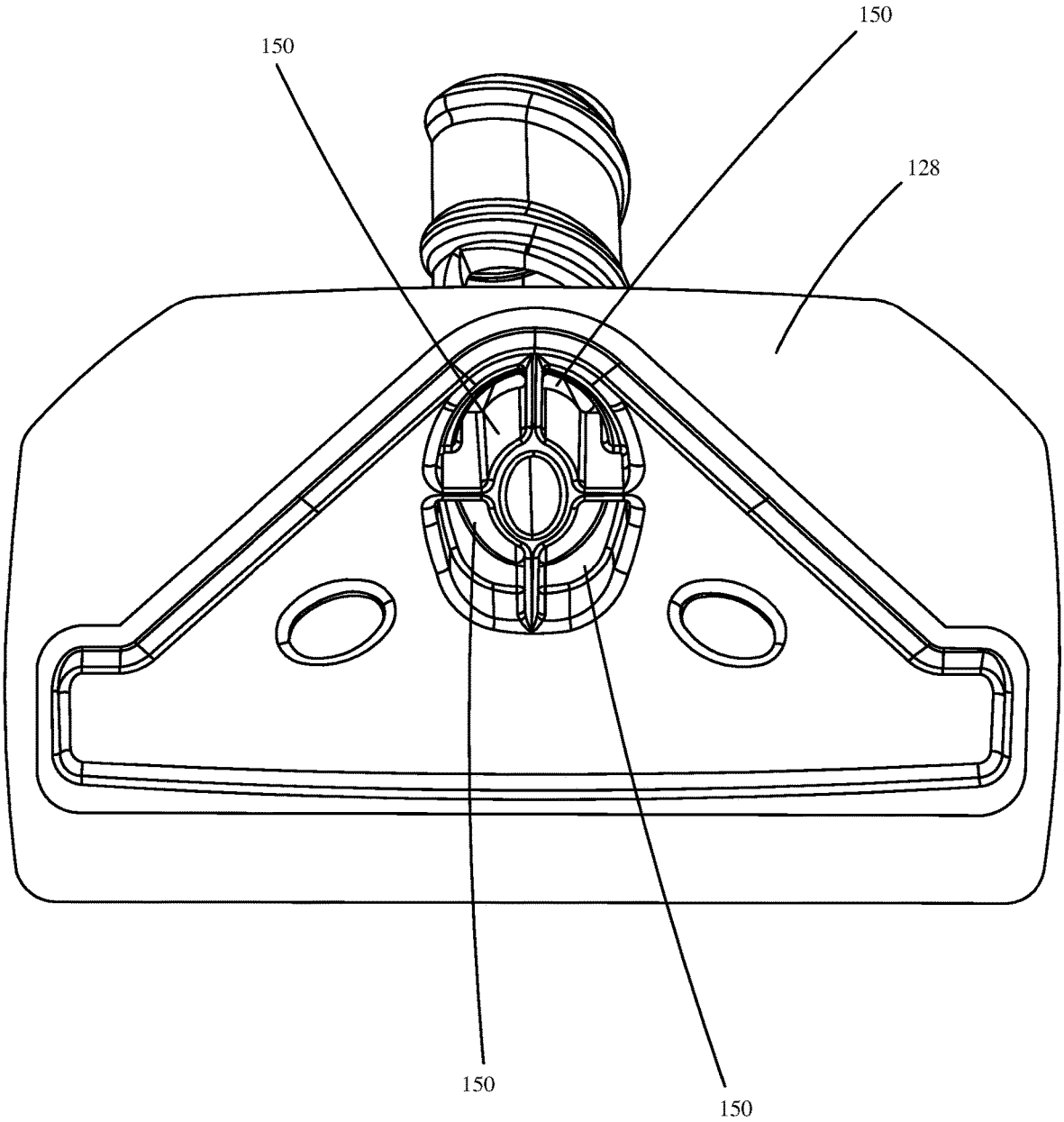
FIG. 8 illustrates a bottom-perspective view of an applicator assembly with fluid flow channels, in accordance with one embodiment.

FIG. 8 illustrates a bottom-perspective view of applicator assembly 106 with fluid flow channels 150, in accordance with one embodiment. Fluid flow channels 150 are generally configured to provide a passageway that permits fluid to flow from flow channel 146 (e.g., when valve mechanism 152 is open) to one or more other portions of applicator assembly 106. In the illustrated example, fluid flow channels 150 are disposed on a bottom portion of applicator base 128 such that channels 150 correspond to the helical arrangement that allows for variably opening and closing valve mechanism 152. In other words, some, but not all, of fluid flow channels 150 receive the fluid from flow channel 146 when valve mechanism 152 is partially open. In one example, all of fluid flow channels 150 receive the fluid flow from flow channel 146 when valve mechanism 152 is in a fully opened position (e.g., maximum rotation of flow regulator 110), while none of fluid flow channels 150 receive the fluid flow when valve mechanism 152 is in a fully closed position. It is noted that, while four channels 150 are illustratively shown in FIG. 8, any number of channels 150 can also or alternatively be used.

Turning again to FIGS. 6 and 7, applicator base 128 further illustratively includes a lip 154 disposed at a second end. Lip 154 is generally configured to couple a pad 136 to applicator base 128. Lip 154 illustratively engages a surface 140 of pad 136 to secure pad 136 to applicator base 128. In one example, pad 136 is removable from fluid applicator device 100 by disengaging lip 154 with surface 140, for example for cleaning or providing improved access to various other features of applicator assembly 106.

Pad 136 generally includes any material or surface that accumulates fluid and applies the accumulated fluid to work surface 107 by contacting work surface 107. In one example of operation, bottom surface 125 of pad 136 contacts work surface 107 and is moved across work surface 107 such that bottom surface 125 applies the accumulated fluid to work surface 107. Of course, it is noted that, alternatively or in addition to pad 136, assembly 106 can include one or more of a brush, a sponge, and a roller, among others (e.g., porous, semi-porous, etc.), configured to contact and apply the fluid to work surface 107.

In one example, fluid applicator device 100 is configured to apply a stain or other fluid to a work surface formed by spaced apart members, such as boards of a deck. The spaced apart members have corresponding adjacent surfaces that face one another and define gaps therebetween. In this example, applicator assembly 106 includes bristles, or other features, that extend from the bottom surface of pad 136 and are configured to engage the adjacent surfaces that form the gaps.

Dispersion interface 132 is illustratively disposed between applicator base 128 and pad 136. Dispersion interface 132 includes any number of openings 134, which can generally be disposed in any orientation on dispersion interface 132. Dispersion interface 132 disperses the flow of fluid, from fluid flow channels 150, through openings 134 and to a top portion of pad 136. In one example, openings 134 are arranged on dispersion interface 132 such that they are configured to distribute the flow of fluid across (or through) the pad 136 in a relatively even manner. In other words, dispersion interface 132 is configured to prevent uneven distribution of fluid across pad 136, and thus is configured to prevent uneven distribution of fluid to work surface 107.

Pad 136 includes, in the illustrated example, slit or opening 138. Dispersion interface 132 is generally configured to align with slit 138 such that fluid is dispersed from openings 134 to slit 138. Thus, slit 138 transports fluid through pad 136 to work surface 107. In one example of pad 136 that does not include slit 138, pad 136 is configured to receive fluid flow from openings 134 such that the fluid contacts a top surface 127 of pad 136 and is partially absorbed by pad 136. In such an example, bottom surface 125 of pad 136 receives a portion of the absorbed fluid and applies the fluid by moving bottom surface 125 across work surface 107.

Applicator assembly 106 can also include one or more sealing engagements, generally indicated by reference numeral 142 (e.g., as shown in FIG. 7), that engage a portion of applicator assembly 106 near fluid flow channels 150.

Sealing engagements 142 are configured to form a leak-proof seal between fluid flow channels 150 and dispersion interface 132, for example.

As such, in operation, a user can rotate any component of a stain applicator assembly (e.g. handle 102, reservoir 108, flow regulator 110, etc.) to open or close valve mechanism 152 and control a rate at which fluid is dispersed to pad 136, via dispersion interface 132, and thereby control a rate at which fluid is applied to work surface 107 by pad 136.

Figure 9:
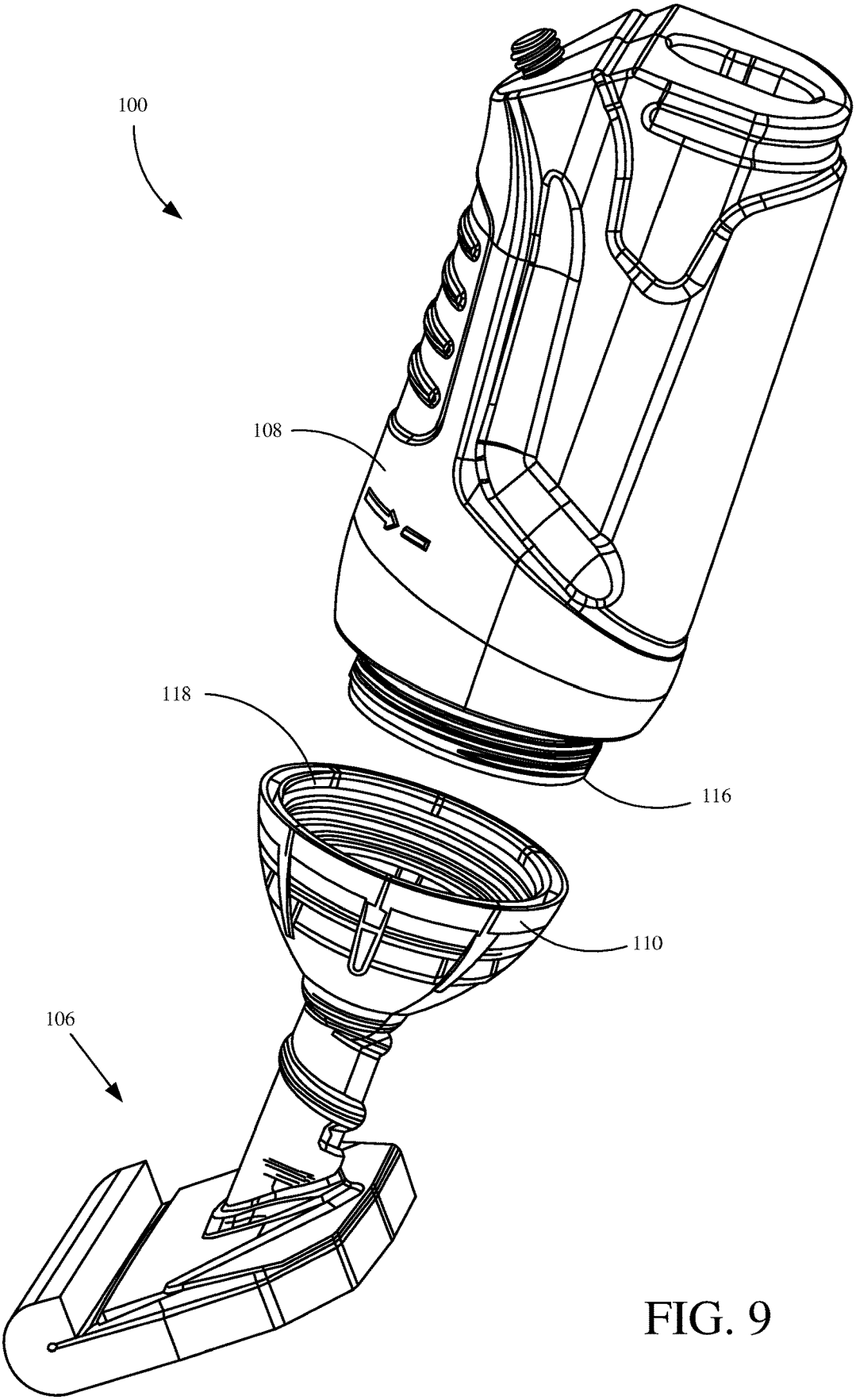
FIG. 9 illustrates a portion of the exploded view of the fluid applicator device shown in FIG. 2, with a flow regulator and a reservoir.

FIG. 9 illustrates a portion of the exploded view of the fluid applicator assembly shown in FIG. 2, with flow regulator 110 and reservoir 108. Flow regulator 110 is configured to be threadably coupled to reservoir 108. Reservoir 108 illustratively includes a threaded section 116. Threaded section 116 is disposed on an exterior surface of reservoir 108. Flow regulator 110 also includes a threaded section 118, which is illustratively disposed around an interior surface of flow regulator 110. Threaded section 116 is configured to engage threaded section 118 such that reservoir 108 is removably couplable to flow regulator 110. That is, flow regulator 110 can be threaded onto (or threaded off to be removed from) reservoir 108 by engaging threads 116 with threads 118.

Threads 116 and 118 are generally shown in the illustrated example as being threaded in a same direction. This same direction of threading configures the coupling between reservoir 108 and flow regulator 110 such that rotation of any of these components, to control fluid flow, does not undesirably unthread the coupling and cause flow regulator 110 to detach from reservoir 108. To further illustrate this arrangement, reservoir 108 is configured to be rotated in a first direction (e.g. clockwise, to thereby move flow regulator 110 in the direction indicated by arrow 162, as discussed with respect to FIG. 5) to increase the threaded coupling between reservoir 108 and flow regulator 110. That is, rotation of reservoir 108 in the first direction, to increase the flow of fluid, will further thread flow regulator 110 onto reservoir 108 until maximum threading is reached (e.g., fully attached). When maximum threading is reached, further rotation of reservoir 108 in the first direction is imparted to flow regulator 110 to increase fluid flow. Reservoir 108 is also configured to be rotated in a second direction (e.g. counter-clockwise, to thereby move flow regulator 110 in the direction indicated by arrow 164, as illustrated by FIG. 5) to decrease the threaded coupling between reservoir 108 and flow regulator 110. That is, rotation of reservoir 108 in the second direction, to decrease fluid flow, can also un-thread flow regulator 110 from reservoir 108. However, it is noted that reservoir 108 is rotatable in the second direction to a threshold distance of rotation that will prevent un-threading while also decreasing fluid flow. That is, once rotation of reservoir 108 in the second direction moves fluid applicator device 100 back to the resting position (e.g., where flow regulator 110 is fully displaced downward along arrow 164 to close valve mechanism 152, as illustrated by FIG. 5), any further rotation of reservoir 108 in the second direction will begin to un-thread flow regulator 110 from reservoir 108.

Figure 10:
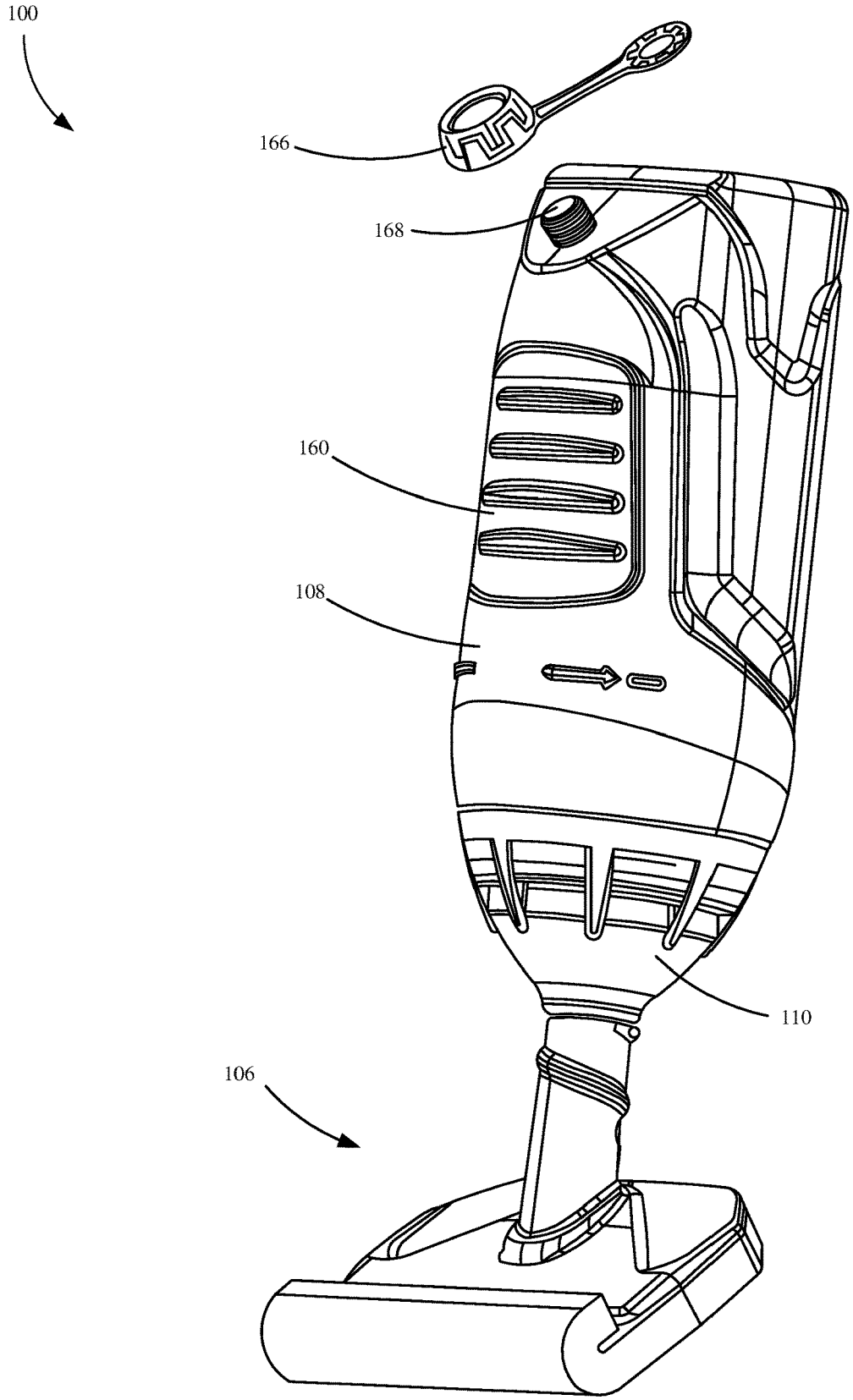
FIG. 10 illustrates a perspective view of the fluid applicator device, shown in FIG. 1, with a handle removed.

FIG. 10 illustrates a perspective view of the fluid applicator assembly, shown in FIG. 1, with handle 102 removed. FIG. 10 generally illustrates one example of fluid applicator device 100 that can be used, in operation, without handle 102. That is, when use of handle 102 is undesired or cumbersome (e.g., when applying a fluid in hard to reach areas, etc.), handle 102 can be removed from fluid applicator device 100, and reservoir 108 is configured to effectively act as a handle (e.g., for pushing, pulling, rotating, etc. fluid applicator device 100).

Reservoir 108 illustratively includes a surface 160 to be gripped by a user. As such, surface 160 can be used to rotate reservoir 108 in the first or second directions of rotation. Surface 160 generally includes a gripping pattern or portion that is configured to improve grip of a user when rotating or otherwise handling a portion of fluid applicator device 100 to control fluid flow and apply a fluid to a surface.

FIG. 10 also illustratively shows that fluid applicator device 100 includes a reservoir opening 168 and a reservoir opening cap 166. Reservoir opening 168 is generally configured to provide an opening that allows access to an interior space, that holds a fluid, from the exterior of reservoir 108. Cap 166 is configured to be threaded or otherwise removably couplable to reservoir opening 168. Thus, in operation, user can remove cap 166 to add a fluid material, such as deck stain, to reservoir 108, and re-attach cap 166 to secure the fluid material within the body.

Figure 11:
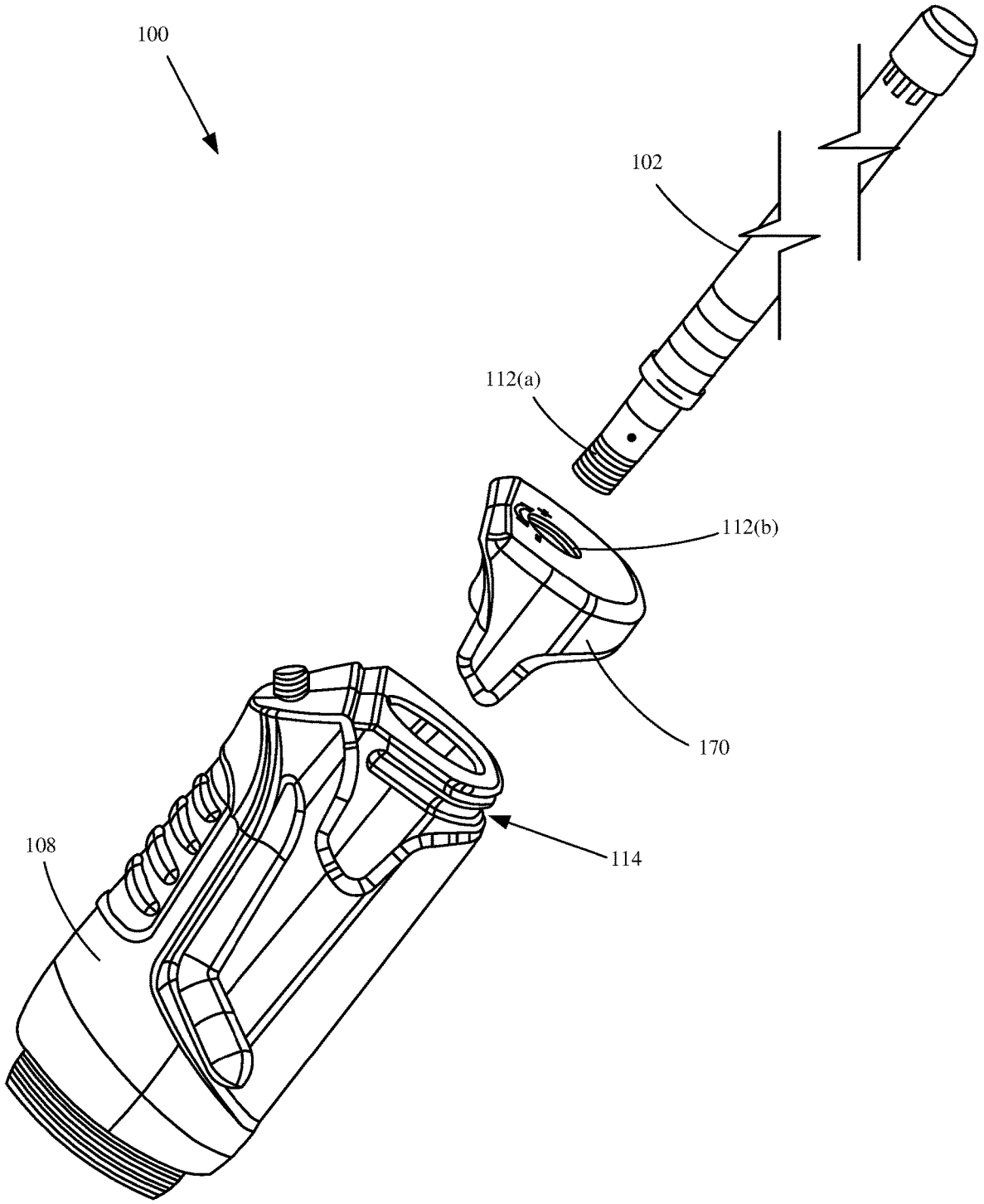
FIG. 11 illustrates a portion of the exploded view of the fluid applicator device, shown in FIG. 2, with a handle and a handle fastening component.

FIG. 11 illustrates a portion of the exploded view of fluid applicator device 100 shown in FIG. 2, with handle 102 and a handle fastening component 170. Handle fastening component 170 is configured to provide a removable coupling between handle 102 and reservoir 108. In the illustrated example, handle 102 includes a threaded portion 112(*a*) that is configured to be received by a corresponding threaded portion 112(*b*) disposed on handle fastening component 170. Handle fastening component 170 can be further coupled to reservoir 108 by one or more attaching mechanisms (generally shown at reference numeral 114, e.g., a threaded portion, a snap-on or clip mechanism, etc.).

Handle 102 is generally configured to be threaded to, and un-threaded from, handle fastening component 170 according to a particular threaded direction. For instance, threads 112(*a*) and 112(*b*) correspond to a same threaded direction. Handle 102 is rotatable in a first direction (e.g., a direction of rotation that corresponds to the same threaded direction, such as rotation of handle 102 in a clockwise direction) to thread handle 102 onto handle fastening component 170, thereby attaching handle 102 to reservoir 108. Handle 102 is rotatable in a second, opposite direction (e.g., counter-clockwise) to un-thread handle 102 from handle fastening component 170, thereby detaching handle 102 from handle fastening component 170. As similarly discussed above with respect to FIG. 9 (and the threaded coupling between reservoir 108 and flow regulator 110), the threaded coupling between handle 102 and reservoir 108 configures handle 102 to be rotatable to both remove or attach handle 102 as well as control fluid flow.

In the illustrated example, threads 112(*a*) and 112(*b*) define a same threaded direction as that of threads 116 and 118. Handle 102 is therefore rotatable, in the first direction (e.g., clockwise), to thread handle 102 onto reservoir 108 until maximum threading is reached (e.g., handle 102 is fully attached to reservoir 108 via handle fastening component 170), and any further rotation of handle 102 in the first direction rotates reservoir 108 and flow regulator 110 to increase fluid flow. Similarly, handle 102 is therefore rotatable, in the second direction (e.g., counter-clockwise), to rotate reservoir 108 and flow regulator 110 to the resting position (e.g., when valve mechanism 152 is fully closed), and any further rotation of handle 102 in the second direction un-threads handle 102 from handle fastening component 170.

The same direction of threading the threads handle 102 to reservoir 108, and flow regulator 110 to reservoir 108, is generally an opposite direction of threading as that of threads 122 and 126. Therefore, rotation of components, such as handle 102 and/or reservoir 108, in a first direction maintains the threaded connections between handle 102 and reservoir 108, and between reservoir 108 and flow regulator 110, while also increasing fluid flow. Correspondingly, rotation of components, such as handle 102 and/or reservoir 108, in a second direction decreases fluid flow until valve mechanism 152 is fully closed, and any further rotation in the second direction begins to un-thread the coupled components. Handle 102 is first to be un-threaded when handle 102 is gripped by a user and rotated in the second direction beyond the fully closed position of valve mechanism 152. Flow regulator 110 is first to be un-threaded, however, when reservoir 108 is gripped by a user and rotated in the second direction beyond the fully closed position of valve mechanism 152.

It should also be noted that the different embodiments described herein can be combined in different ways. That is, parts of one or more embodiments can be combined with parts of one or more other embodiments. All of this is contemplated herein.

Although the subject matter has been described in language specific to structural features and/or methodological acts, it is to be understood that the subject matter is not necessarily limited to the specific features or acts described above. Rather, the specific features and acts described above are disclosed as example forms of implementing the described subject matter.

What is claimed is:

1. A fluid applicator device comprising:

an applicator assembly configured to apply a fluid to a surface;

a reservoir assembly comprising a reservoir configured to store the fluid and a flow regulator configured to control a flow of the fluid to the applicator assembly, the reservoir assembly being rotatably coupled to the applicator assembly by a helical coupling, wherein the reservoir assembly is rotatable about an axis of rotation, relative to the applicator assembly, in a first direction along the helical coupling, away from the applicator assembly to increase the flow of the fluid to the applicator assembly, and in a second direction along the helical coupling, toward the applicator assembly, to decrease the flow of fluid to the applicator assembly;

a handle removably coupled to and extending from the reservoir assembly; and a locking mechanism configured to selectively couple the applicator assembly to the reservoir assembly, the locking mechanism comprising a protrusion and a slot configured to receive the protrusion, wherein the protrusion protrudes in a direction away from the axis of rotation and is movable within the slot as the reservoir assembly is rotated in the first direction and the second direction relative to the applicator assembly.

2. The fluid applicator device of claim 1, wherein the reservoir assembly is rotatable in the first direction to increase the flow of the fluid through a valve mechanism, and rotatable in the second direction to decrease the flow of the fluid through the valve mechanism.

3. The fluid applicator device of claim 2, and further comprising:

a flow channel configured to fluidically couple the applicator assembly to the reservoir assembly.

4. The fluid applicator device of claim 3, wherein the reservoir assembly is rotatable in the first direction to open the valve mechanism and permit the flow of the fluid through the flow channel, and rotatable in the second direction to close the valve mechanism and prevent the flow of the fluid through the flow channel.

5. The fluid applicator device of claim 1, wherein the applicator assembly comprises:

an applicator pad configured to contact the surface and is movable across the surface to dispense the fluid to the surface.

6. The fluid applicator device of claim 1, wherein the reservoir assembly is rotatable in the second direction to move the reservoir assembly, along the helical coupling, towards the applicator assembly to close a valve mechanism.

7. The fluid applicator device of claim 6, wherein the flow regulator is configured to engage a portion of the applicator assembly to close the valve mechanism and disengage the portion of the applicator assembly to open the valve mechanism.

8. The fluid applicator device of claim 7, wherein the flow of fluid to the applicator assembly is based on the spacing between the flow regulator and the portion of the applicator assembly.

9. The fluid applicator device of claim 1, wherein the protrusion protrudes radially relative to the axis of rotation.

10. The fluid applicator device of claim 1, wherein the protrusion comprises a screw.

11. The fluid applicator device of claim 1, wherein the slot defines a first rotational stop and a second rotational stop of the protrusion as the reservoir assembly is rotated in the first direction and the second direction.

12. The fluid applicator device of claim 1, wherein the slot is formed in a surface of the applicator assembly.

13. A fluid applicator device comprising:

an applicator assembly configured to apply a fluid to a surface;

a valve mechanism configured to control a flow of the fluid to the applicator assembly;

a reservoir assembly rotatably coupled to the applicator assembly by a helical coupling and configured to store the fluid, the reservoir assembly rotatable about an axis of rotation, relative to the applicator assembly, in a first direction along the helical coupling away from the applicator assembly to an open position of the valve mechanism, and in a second direction along the helical coupling toward the applicator assembly to a closed position of the valve mechanism; and a locking mechanism configured to selectively couple the applicator assembly to the reservoir assembly, the locking mechanism comprising a protrusion and a slot configured to receive the protrusion, wherein the protrusion protrudes in a direction away from the axis of rotation and is movable within the slot as the reservoir assembly is rotated in the first direction and the second direction.

14. The fluid applicator device of claim 13, wherein the valve mechanism is configured to:

permit the flow of the fluid, from the reservoir assembly to the applicator assembly, when the valve mechanism is in the open position, and prevent the flow of the fluid, from the reservoir assembly to the applicator assembly, when the valve mechanism is in the closed position.

15. The fluid applicator device of claim 13, wherein the reservoir assembly comprises a stem portion that is rotatable about the axis of rotation.

16. The fluid applicator device of claim 15, wherein the applicator assembly comprises a portion configured to be engaged by the stem portion.

17. The fluid applicator device of claim 16, wherein the reservoir assembly is rotatable to correspondingly rotate the stem portion in the first direction, about the axis of rotation, and wherein the fluid applicator device is configured to:

based on rotation of the stem portion in the first direction, move the stem portion away from the portion of the applicator assembly such that the stem portion disengages the portion of the applicator assembly and opens the valve mechanism.

18. The fluid applicator device of claim 16, wherein the reservoir assembly is rotatable to correspondingly rotate the stem portion in the second direction, about the axis of rotation, and wherein the fluid applicator device is configured to:

based on rotation of the stem portion in the second direction, move the stem portion towards the portion of the applicator assembly such that the stem portion engages the portion of the applicator assembly and closes the valve mechanism.

19. A fluid applicator device comprising:

an applicator assembly configured to apply a fluid to a surface;

a reservoir assembly comprising a reservoir configured to store the fluid and a flow regulator configured to control a flow of the fluid to the applicator assembly, the reservoir assembly being rotatably coupled to the applicator assembly by a helical coupling, wherein the reservoir assembly is rotatable about an axis of rotation, relative to the applicator assembly, in a first direction along the helical coupling, away from the applicator assembly to increase the flow of the fluid to the applicator assembly, and in a second direction along the helical coupling, toward the applicator assembly, to decrease the flow of the fluid to the applicator assembly;

a handle removably coupled to and extending from the reservoir assembly;

a locking mechanism configured to selectively couple the applicator assembly to the reservoir assembly, the locking mechanism comprising a protrusion and a slot configured to receive the protrusion, wherein the protrusion protrudes in a direction away from the axis of rotation and is movable within the slot as the reservoir assembly is rotated in the first direction and the second direction relative to the applicator assembly; and wherein the helical coupling comprises a first helical coupling, and the handle is removably coupled to the reservoir by a second helical coupling comprising helically arranged grooves oriented in a same direction as the first helical coupling.

20. The fluid applicator device of claim 19, wherein the first helical coupling is configured to:

in response to rotation of the reservoir assembly in the first direction, move the reservoir assembly along a helical arrangement away from the applicator assembly, to orient the flow regulator in a first position; and in response to rotation of the reservoir assembly in the second direction, move the reservoir assembly along the helical arrangement towards the applicator assembly, to orient the flow regulator in a second position.

* * * * *